United States Patent [19]

Spector

[11] Patent Number: 4,521,205

[45] Date of Patent: Jun. 4, 1985

[54] SOUND TAPE PLAYER HAVING AN ANIMATED CHARACTER

[76] Inventor: Donald Spector, 380 Mountain Rd., Union City, N.J. 07087

[21] Appl. No.: 615,380

[22] Filed: May 30, 1984

[51] Int. Cl.[3] ..... A63H 3/28

[52] U.S. Cl. ..... 446/302; 446/297; 446/299; 446/219; 446/408; 206/387; 434/308; D14/11; D14/6

[58] Field of Search ..... 446/219, 297, 299, 300, 446/301, 302, 408, 484, 485; 360/88, 92, 93, 132, 134; D21/64, 111, 112, 113; D14/3, 6, 10, 11, 69; 340/815.11; 434/308, 309

[56] References Cited

U.S. PATENT DOCUMENTS

| | | | |
|---|---|---|---|
| D. 250,023 | 10/1978 | Perkins et al. | D21/111 |
| D. 253,311 | 10/1979 | Ming | D14/6 |
| 1,479,794 | 1/1924 | Emerson | 434/309 |
| 1,666,946 | 4/1928 | Sherlock | 446/297 X |
| 2,933,853 | 4/1960 | Laval | 446/219 |
| 3,583,093 | 6/1971 | Glass | 446/299 |
| 3,641,684 | 2/1972 | Paige | 206/387 X |
| 3,685,200 | 8/1972 | Noll | 446/299 |
| 3,726,030 | 4/1973 | Wilson | 206/387 |
| 3,866,751 | 2/1975 | Holert | 206/387 |
| 3,927,402 | 12/1975 | Thompson | 340/815.11 |

*Primary Examiner*—Robert A. Hafer
*Assistant Examiner*—D. Neal Muir
*Attorney, Agent, or Firm*—Michael Ebert

[57] ABSTRACT

A player for a pre-recorded sound magnetic tape package in a cartridge or a cassette format in which each package is united with a three-dimensional character thematically related to the recording and animated thereby. The character is provided with eye and mouth openings covered by translucent elements. Housed in the character are light guides extending from the eye and mouth elements to a common optical inlet. When the package is inserted in the player to effect actuation thereof, the character is then at an erect position thereabove and the optical inlet is then in registration with a light outlet on the player behind which is a light bulb connected to the audio output thereof. As the recorded sound is reproduced, the light emitted by the bulb is modulated in accordance therewith. The resultant light pulses are conveyed by the guides to the eye and mouth elements to impart animation to the character in synchronism with the reproduced sound.

9 Claims, 7 Drawing Figures

Fig. 1.
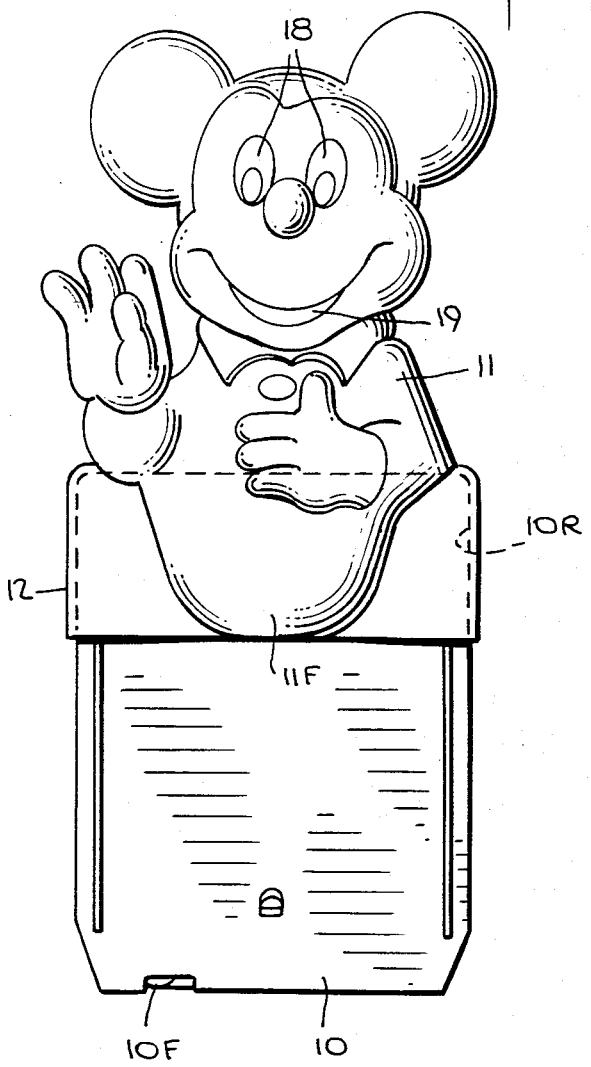
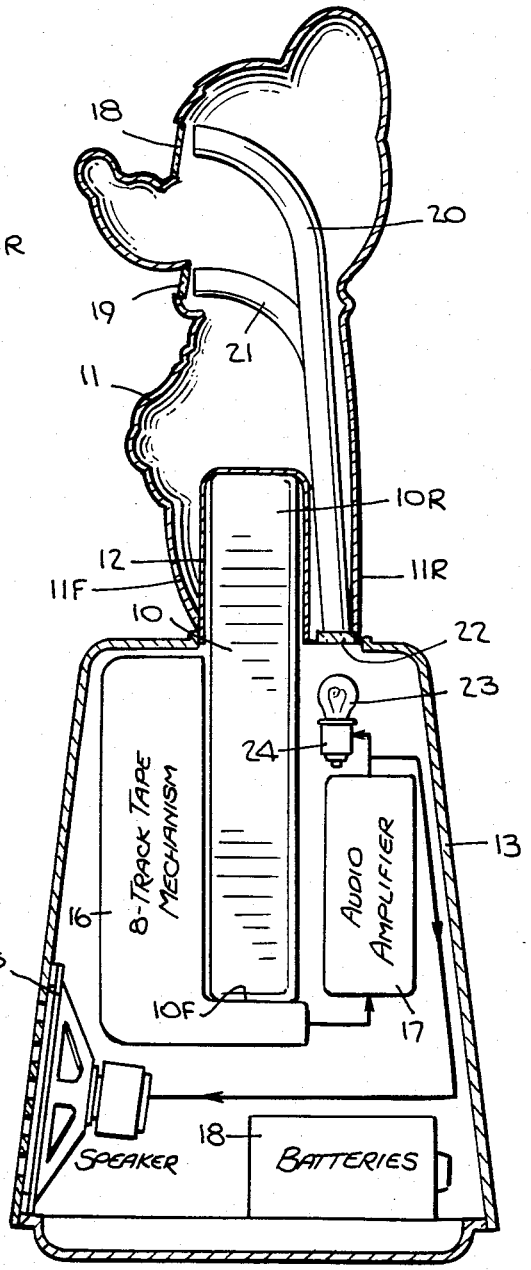
Fig. 2.

Fig. 3.
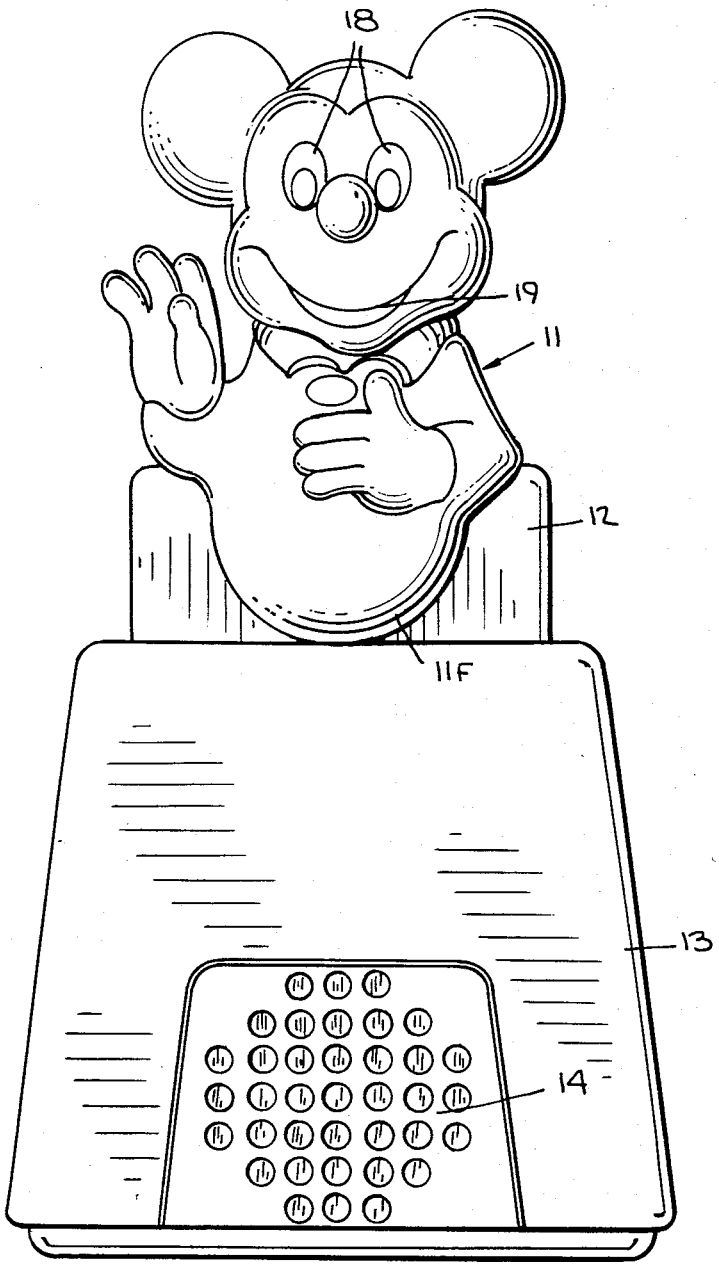
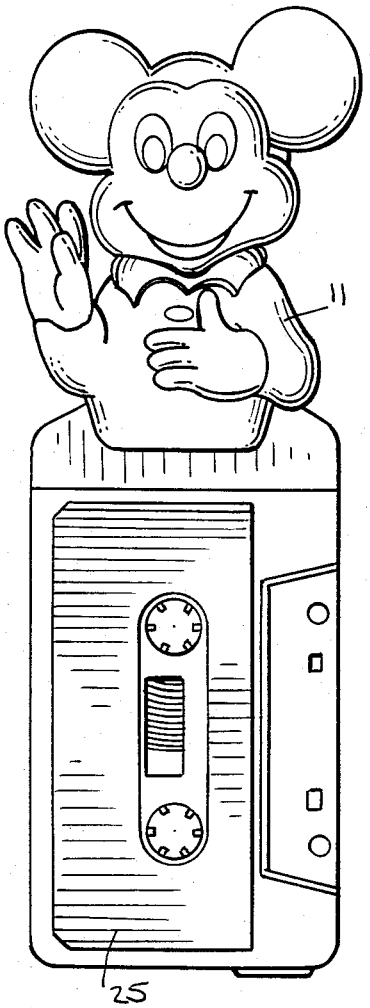
Fig. 4.

SOUND TAPE PLAYER HAVING AN ANIMATED CHARACTER

BACKGROUND OF INVENTION

1. Field of Invention

This invention relates generally to players for pre-recorded magnetic sound tapes, and in particular to a player for tape packages in a cassette or cartridge format in which each package is united with a three-dimensional character thematically related to the recording, the character having eye and mouth openings covered by translucent elements to which light pulses are applied when the recording is being played to impart animation to the character in synchronism with the reproduced sound.

In a magnetic tape sound system operating in the recording mode, the audio signal to be recorded is applied to the coil of a recording head. As the tape is advanced across the head at a constant speed, magnetization is induced in the tape in proportion to the current flowing in the coil. In the playback mode, as the tape advances at the same speed across a reproducing head, flux from the tape intercepts the pick-up coil of the head, the flux variations in the tape inducing an emf in the coil which is amplified and reproduced in a loudspeaker.

Magnetic tape is generally packaged in either a cartridge or cassette format. Many such pre-recorded tape packages are expressly designed for the children's market. A child listening to a tape recording hears sounds emanating from what is essentially a disembodied source, for the typical player has a non-representational or utilitarian form. In order, therefore, to enhance the listening experience, it is known to provide novelty-type players having a molded casing in the form of a familiar character such as Mickey Mouse or Superman.

Such novelty record players are altogether inaminate, and the character embodied thereby bears no relationship at all to the recording. Thus if a child listens to a tape recording of a story whose principal character is Superman, Wonder Woman or some other popular superhero, a Mickey Mouse novelty player would be incompatible with this recording. By the same token, a musical recording of a singer popular with children (or adolescents) such as Michael Jackson, if played on a Mickey Mouse player, would strike, as it were, a discordant note.

SUMMARY OF INVENTION

In view of the foregoing, the main object of this invention is to provide a player for a pre-recorded magnetic tape sound package in which the package is united to a three-dimensional character thematically related to the recording, the character acting as a handle to facilitate insertion of the package in the player.

More particularly, an object of this invention is to provide a player acting in combination with a tape package of the above type in which the reproduced audio signal is also applied to a light source to modulate the light produced thereby, the resultant light pulses being conveyed by light guides in the character to translucent elements in the eyes and mouth to impart animation to the character as the recording is being played.

A significant aspect of the invention is that the animation simulated by light pulses is in synchronism with the recording so that the character appears to be speaking or singing the sounds which emanate from the loudspeaker, thereby giving the impression that the character and not the player is the source of the sounds, and enhancing the listening experience.

An important feature of the invention is that the character rather than data on a printed label acts to generally identify the nature of the recording, so that a child not quite able to read can nevertheless select a recording that is to his taste.

Also, an object of the invention is to provide a character having light guides housed therein which have a common optical inlet that is operatively coupled to a light bulb in the player only when the tape package to which the character is united, is inserted in the player.

Briefly stated, these objects are attained in a player for a pre-recorded sound magnetic tape package in a cartridge or a cassette format in which each package is united with a three-dimensional character thematically related to the recording and animated thereby. The character is provided with eye and mouth openings covered by translucent elements. Housed in the character are light guides extending from the eye and mouth elements to a common optical inlet. When the package is inserted in the player to effect actuation thereof, the character is then at an erect position thereabove and the optical inlet is then in registration with a light outlet on the player behind which is a light bulb connected to the audio output thereof. As the recorded sound is reproduced, the light emitted by the bulb is modulated in accordance therewith. The resultant light pulses are conveyed by the guides to the eye and mouth elements to impart animation to the character in synchronism with the reproduced sound.

OUTLINE OF DRAWINGS

For a better understanding of the invention as well as other objects and further features thereof, reference is made to the following detailed description to be read in conjunction with the accompanying drawings, wherein:

FIG. 1 is a front view of an animated character magnetic tape package of the cartridge type in accordance with the invention;

FIG. 2 is a side view, partly in section, of the character tape package when it is inserted in a tape player;

FIG. 3 is a front view of the animated character tape package and the player therefor;

FIG. 4 illustrates, in front view a character tape package of the cassette type;

Figure 6:
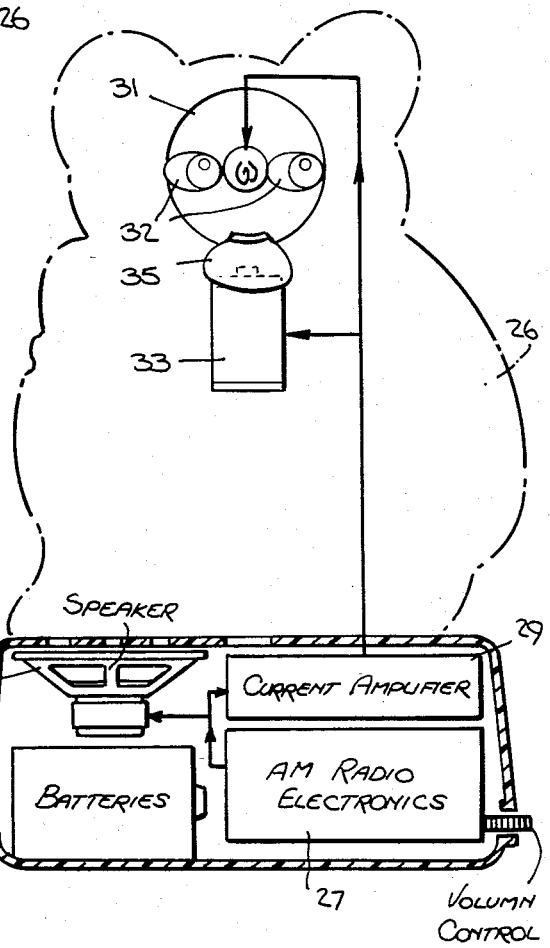
Figure 7:
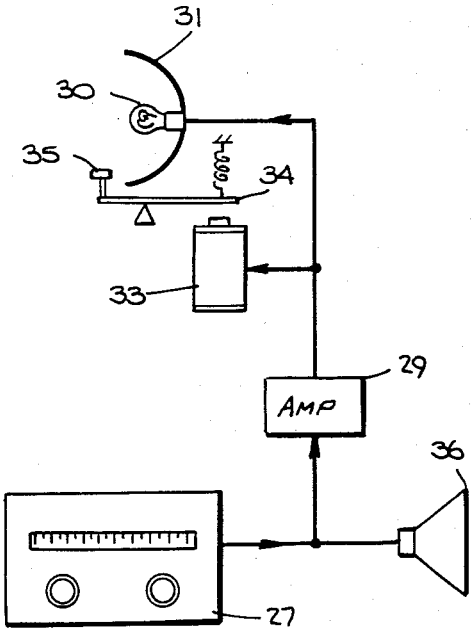

FIG. 6 schematically illustrates the interior component of the character radio; and FIG. 7 is a diagram of the character-animation elements of the radio.

DESCRIPTION OF INVENTION

First Embodiment

Referring now to FIGS. 1, 2 and 3, there is shown an animated character magnetic tape sound player in accordance with the invention which includes a magnetic tape package 10 which may be of the eight track or any other standard type. United with the cartridge is a three-dimensional character 11 functioning as a handle therefor to facilitate insertion of the cartridge in a player which is designed to display the character in an erect position. The character may be molded of high-strength synthetic plastic material such as PVC and appropriately colored and decorated.

A conventional magnetic tape cartridge has a front portion 10F in which the stored tape is exposed at the edge thereof to a reproducing head, and a rear portion 10R. The rear portion is used as a handle when the cartridge is inserted in the slot of the player, the rear portion then projecting outwardly from the slot.

In the present arrangement, rear portion 10F of the cartridge is press fit into a generally rectangular socket 12, the socket being received and held within a rectangular notch in the base of character 11. Thus the front portion 11F of the character base overlies the front wall of socket 12 and the rear portion 11R of the base overlies the rear wall of the socket.

Formed in the flat top wall of the box-like casing 13 of the player is a slot to receive the inserted cartridge, the cartridge then being seated on a tape playback mechanism 16 of standard design. On the front wall of the casing is a grill 14 behind which is a sound transducer or loudspeaker 15. Commercially-available equipment may be used for this purpose.

When the cartridge is inserted in the player, the player, which may be powered by batteries 18 placed in a battery compartment or by a rectifier power supply connected to an AC power line, is actuated. The cartridge tape is then driven by the playback mechanism 16 at a constant speed past a reproducer head whose pick up coil generates an audio signal. This audio signal is fed to an audio amplifier 17 whose output is applied to loudspeaker 15.

Character 11, which is shown in animal-like form but may be in other representational or fanciful forms depending on the subject matter of the pre-recorded tape, is provided with a pair of eye openings, each covered by a translucent plastic element or lens 18. Character 11 also has a mouth opening covered by a translucent plastic element 19. The eye elements 18 are optically coupled by a pair of light pipes 20 housed in the character to a common optical light inlet 22. This may take the form of a clear plastic plate 22 placed at the underside of the rear portion 11R of the character. The mouth element 19 is also optically coupled by a light pipe 21 to the optical light inlet 22. In practice, these light pipes may be formed by flexible fiber optics cables or by molded plastic light guides having light conducting properties, such as those now commonly used to illuminate light indicators on automobile dashboards.

The output of audio amplifier 17 is also connected to a light bulb 23. This is supported in a socket 24 at a position just below an opening in the top wall of casing 13 of the player which lies in registration with the optical inlet 22 of the character when the cartridge is inserted in the player.

Operation

When the player is actuated by the inserted cartridge, the tape recording which is being played is heard by a listener from loudspeaker 15. At the same time, the audio output of amplifier 17 serves to more or less energize light bulb 23, the resultant light being modulated in accordance with the sound. Inasmuch as the player is provided with a volume control, in practice the output of the audio amplifier, as applied to the light bulb, may bypass the volume control so that the light output is independent of the volume control setting and is at a level providing a bright light.

The light pulses from the light bulb are conveyed to the eye and mouth optical elements to cause these elements to flicker in synchronism with the sound. This light flickering action gives the illusion of eye and mouth movements that are dynamically related to what is being spoken or sung. Thus a loud sound is accompanied by a brighter light than a softer sound and is perceived by the listener as a larger action.

The choice of character is determined by the sound recording. Thus, if the recording is that of a story involving a Disney character, say, Mickey Mouse, then the character united with the cartridge would be Mickey Mouse; and as the recording is being played, it would be Mickey Mouse who would appear to be telling the story. And for a Popeye story, a Popeye-like character would obviously be appropriate. In the case of a recording of a given singer such as Michael Jackson or other popular performer, the character joined to the cartridge would be an effigy of that performer.

In practice, the translucent eye optical elements may be pigmented rather than pure white to simulate eyes, while the mouth may have a whitish pigment. Thus each cartridge to be used with the player would be joined to a character thematically related to the recording.

Second Embodiment

In the arrangement shown in FIG. 4, instead of a cartridge, the character 11 is united with a pre-recorded magnetic tape cassette 25.

In this instance, the player must be provided with a cassette drive mechanism so arranged that when the cassette is loaded into the player through a top slot, the drive for the cassette is then brought into engagement with the tape supply wheels in the cassette and the tape is brought into operative relation by the reproducing head. The operation is otherwise the same as in the first embodiment.

Third Embodiment

Figure 5:
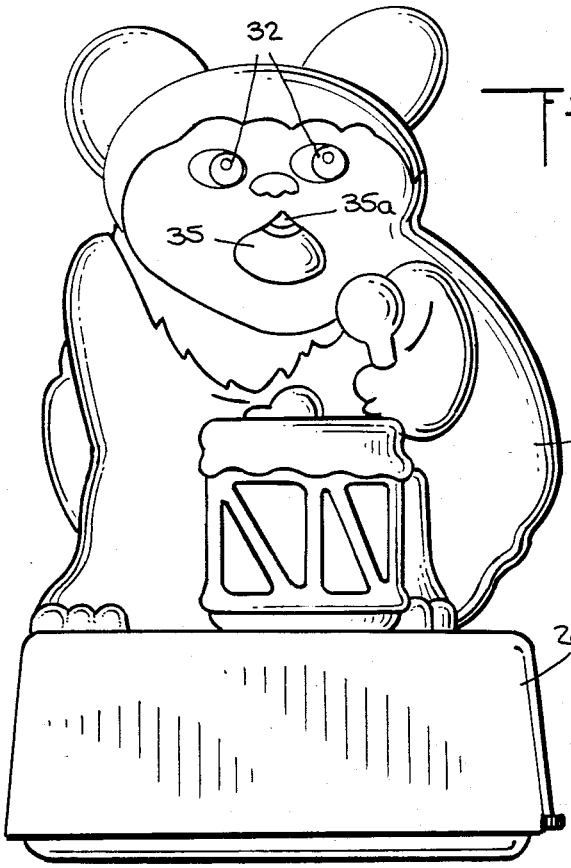
FIG. 5 is a front view of an animated character radio in accordance with the invention.

In the embodiment shown in FIGS. 5, 6 and 7, instead of a magnetic tape recording, the character 26 is animated by the audio output of a standard radio receiver 27 housed in a casing 28 on top of which the character is mounted. The output of the receiver is fed to a loudspeaker 36.

In this instance, the audio output of the receiver is also applied through a suitable current amplifier 29 to a light bulb 30 placed within a reflector 31 located in the character behind the eye openings. These are covered by translucent elements 32.

The audio output is also applied to a solenoid 33 which, through a spring-biased lever 34, operates the movable lower section of a mouthpiece 35 whose complementary upper section 36 is fixed.

The opening between the lower and upper sections of the mouthpiece lies in registration with the periphery of reflector 31 so that as the solenoid swings the movable section of the mouthpiece up and down, this acts to more or less adjust the opening to allow more or less light therethrough from the reflector.

This arrangement is such that as the radio plays, the character 26 is animated thereby, not only in terms of flickering eye and mouth lights, but also in terms of mouth movement. In this instance, the character which is permanently affixed to the casing 28 remains the same regardless of what is being spoken or sung, or by whom.

Thus in the case of the third embodiment in which a radio is joined to an animated character whose eyes and mouth flicker in accordance with the sound and whose mouth is also manipulated, the fixed character, say, "Donald Duck," is thematically unrelated to the sound. However, one may use in in conjunction with this radio a walkie-talkie unit whose frequency setting lies within the broadcast range of the radio so that a child talking into the unit will have his voice transmission picked up and reproduced by the radio when it is set to the frequency of the unit so that now the character appears to be talking with the voice of the child. And one can include in the walkie-talkie unit an audio processor or selective filter which so modifies the voice as to impart thereto a distinctive vocal quality similar to that associated with the radio character.

Thus if the radio character is "Mickey Mouse" and has a squeaky sound, the child's voice can be modified in the unit by emphasizing the high sonic frequencies to make the voice squeaky; and in the case of "Donald Duck," the voice can be distorted as to impart a quacky sound thereto.

In this way, the character on the radio will be thematically related to the sound produced by the radio, this sound originating with the child. And one could provide several walkie-talkie units, each having a different voice modifier, one for each character related to the modified voice, and also provide the radio with plug-in animal characters, each corresponding to a respective unit so that the child has a choice of characters.

While there has been shown and described a preferred embodiment of a sound tape player having an animated character in accordance with the invention, it will be appreciated that many changes and modifications may be made therein without, however, departing from the essential spirit thereof.

I claim:

1. A tape player in combination with sound magnetic tape packages, the combination comprising:

A a three-dimensional character joined to each of said packages and functioning as a handle therefor, said character having eye openings covered by translucent elements;

B light guides extending from an optical inlet on said character to said elements to conduct light thereto;

C a tape player whose case has a light outlet therein and is provided with a slot to receive a tape package whereby when the package is inserted therein the character is exposed to view and said optical inlet is then in registration with said light outlet, said player housing within said case a playback mechanism which is operatively coupled to the inserted package to drive the tape and to produce an audio signal in accordance with the recording on the tape, which signal is fed to an amplifier whose output is applied to a sound producer; and D a light emitter coupled to the output of the amplifier and placed behind the light outlet, the light generated by said emitter being modulated by said signal to produce light pulses which are conveyed to the eye elements to impart animation to the character in synchronism with the reproduced sound.

2. The combination as set forth in claim 1, wherein said character further includes a mouth opening covered by a translucent element coupled by a light guide to said optical inlet.

3. The combination as set forth in claim 1, wherein the character joined to the package is thematically related to the recording therein; different recordings having different characters.

4. The combination as set forth in claim 1, wherein said slot is on top of the case and the character when the package is inserted in the slot is erect.

5. The combination as set forth in claim 1, wherein said package is in a cartridge format and said playback mechanism is of the cartridge type.

6. The combination as set forth in claim 1, wherein said package is in a cassette format and said playback mechanism is of the cassette type.

7. The combination as set forth in claim 2, wherein said optical inlet is common to the respective light guides.

8. The combination as set forth in claim 1, wherein said light emitter is a light bulb.

9. The combination as set forth in claim 1, wherein said light emitter is a light emitting diode.

* * * * *